US005913948A

United States Patent [19]

Lien

[11] Patent Number: 5,913,948

[45] Date of Patent: Jun. 22, 1999

[54] SKIDPROOF COVER FOR ACCELERATOR PEDAL, BRAKE PEDAL, AND CLUTCH PEDAL OF MOTOR VEHICLE

[75] Inventor: Chang Mei Lien, Chan Hua Hsien, Taiwan

[73] Assignee: Outie Co., Ltd., Chan Hua Hsien, Taiwan

[21] Appl. No.: 08/994,272

[22] Filed: Dec. 22, 1997

[30] Foreign Application Priority Data

Dec. 24, 1996 [CN] China ..... 85219982

[51] Int. Cl.[6] ..... G05G 1/16

[52] U.S. Cl. ..... 74/563; 74/560

[58] Field of Search ..... 74/560, 563, 558, 74/558.5; 280/259; 403/257

[56] References Cited

U.S. PATENT DOCUMENTS

| | | | |
|---|---|---|---|
| 1,292,760 | 1/1919 | Grant | 74/563 |
| 1,297,202 | 3/1919 | McGiehan | 74/563 |
| 1,328,400 | 1/1920 | Reich | 74/562 |
| 1,455,675 | 5/1923 | Sinclair | 74/562 |
| 1,572,369 | 2/1926 | Sinclair | 74/562 |
| 2,077,279 | 4/1937 | Snell | 74/560 |
| 2,931,246 | 4/1960 | Lerman | 74/562 |
| 4,899,614 | 2/1990 | Kataumi | 74/560 |
| 5,186,076 | 2/1993 | Kataumi et al. | 74/563 X |
| 5,398,570 | 3/1995 | Chae | 74/563 |

FOREIGN PATENT DOCUMENTS

| | | | |
|---|---|---|---|
| 3-182916 | 8/1991 | Japan | 74/560 |

*Primary Examiner*—Vinh T. Luong
*Attorney, Agent, or Firm*—Harrison & Egbert

[57] ABSTRACT

A skidproof cover for covering a pedal of an accelerator, a brake or a clutch of the motor vehicle and is composed of a main body, a fastening piece, an actuating piece, an actuating bolt, and a locating piece. The main body is provided in the upper surface thereof with a skidproof pad and is mounted on the fastening piece which is in turn fastened securely with the pedal in conjunction with the actuating piece and the locating piece.

1 Claim, 4 Drawing Sheets

SKIDPROOF COVER FOR ACCELERATOR PEDAL, BRAKE PEDAL, AND CLUTCH PEDAL OF MOTOR VEHICLE

FIELD OF THE INVENTION

The present invention relates generally to an automobile accessory, and more particularly to a skidproof cover for the accelerator pedal, the brake pedal, or the clutch pedal of an automotive vehicle.

BACKGROUND OF THE INVENTION

As shown in FIG. 1, a skidproof cover 11 of the prior art for the accelerator pedal, the brake pedal, or the clutch pedal 10 of a car is provided with a plurality of pliable straps 12 for fastening the skidproof cover 11 with the pedal 10. The skidproof cover 11 is provided in the upper surface thereof with a plurality of knobs 13 for preventing the skidding of a foot pressing the pedal 10.

Such a prior art skidproof cover as described above is defective in design in that it can not be securely fastened with the pedal of an accelerator, brake or clutch of a motor vehicle.

SUMMARY OF THE INVENTION

The primary objective of the present invention is to provide an improved skidproof cover which can be securely fastened with the accelerator pedal, the brake pedal or the clutch pedal of a motor vehicle.

In keeping with the principle of the present invention, the foregoing objective of the present invention is attained by the skidproof cover having a main body, a fastening piece, an actuating piece, and a locating piece. The main body is provided in the upper surface thereof with a skidproof pad and is mounted securely on the fastening piece which is, in turn, fastened securely with the pedal in conjunction with the actuating piece and the locating piece.

The foregoing objective, features, functions and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
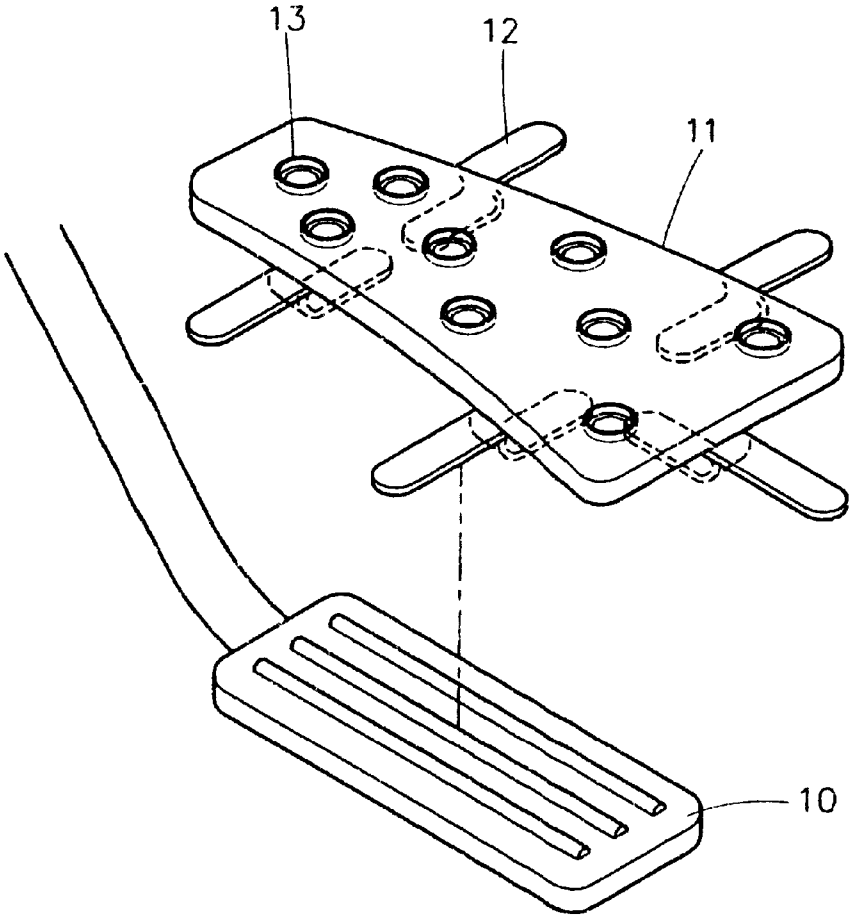
FIG. 1 PRIOR ART
FIG. 1 shows a perspective view of a skidproof cover of the prior art.
Figure 2:
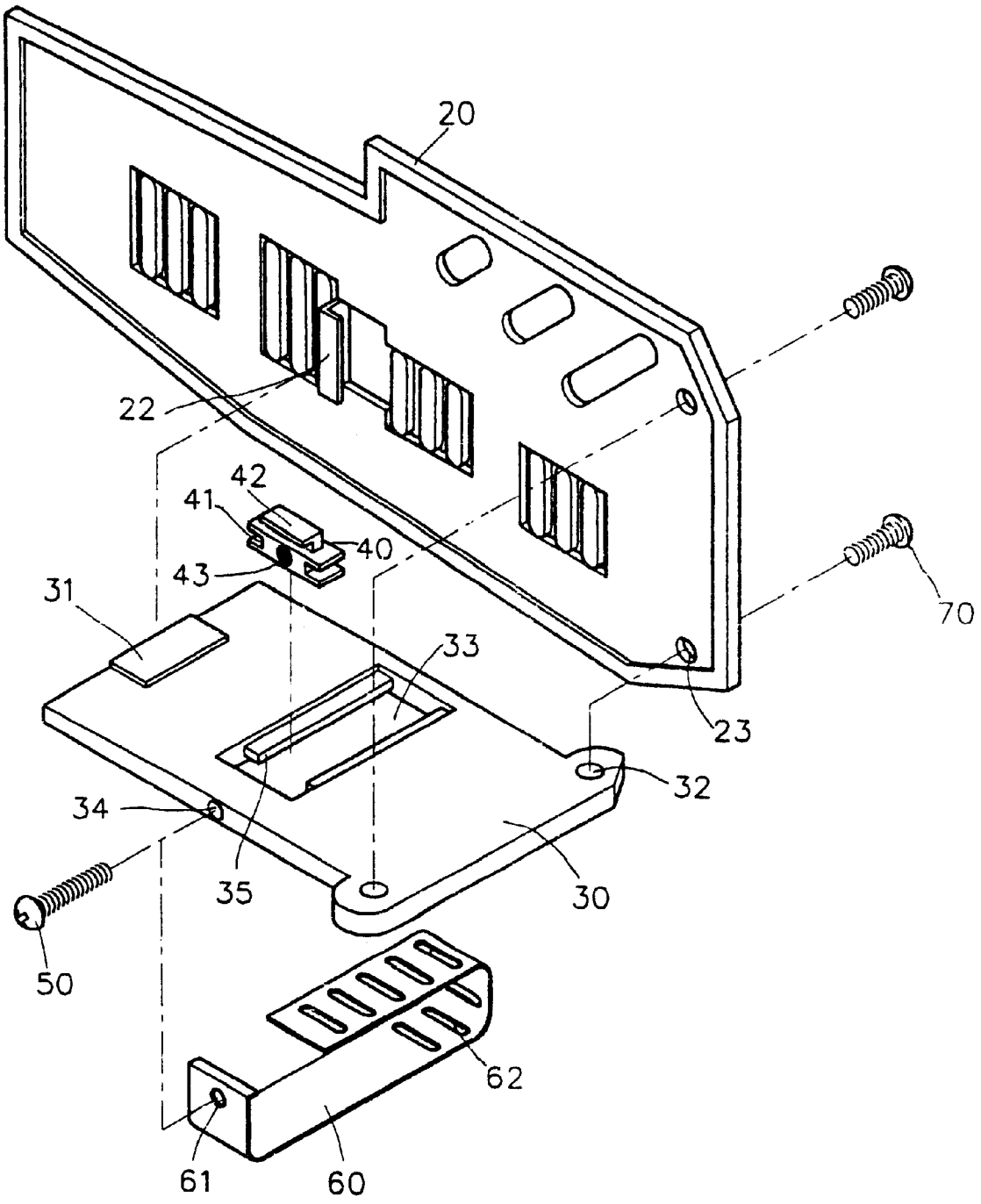
FIG. 2 shows an exploded view of a skidproof cover of the present invention.
Figure 3:
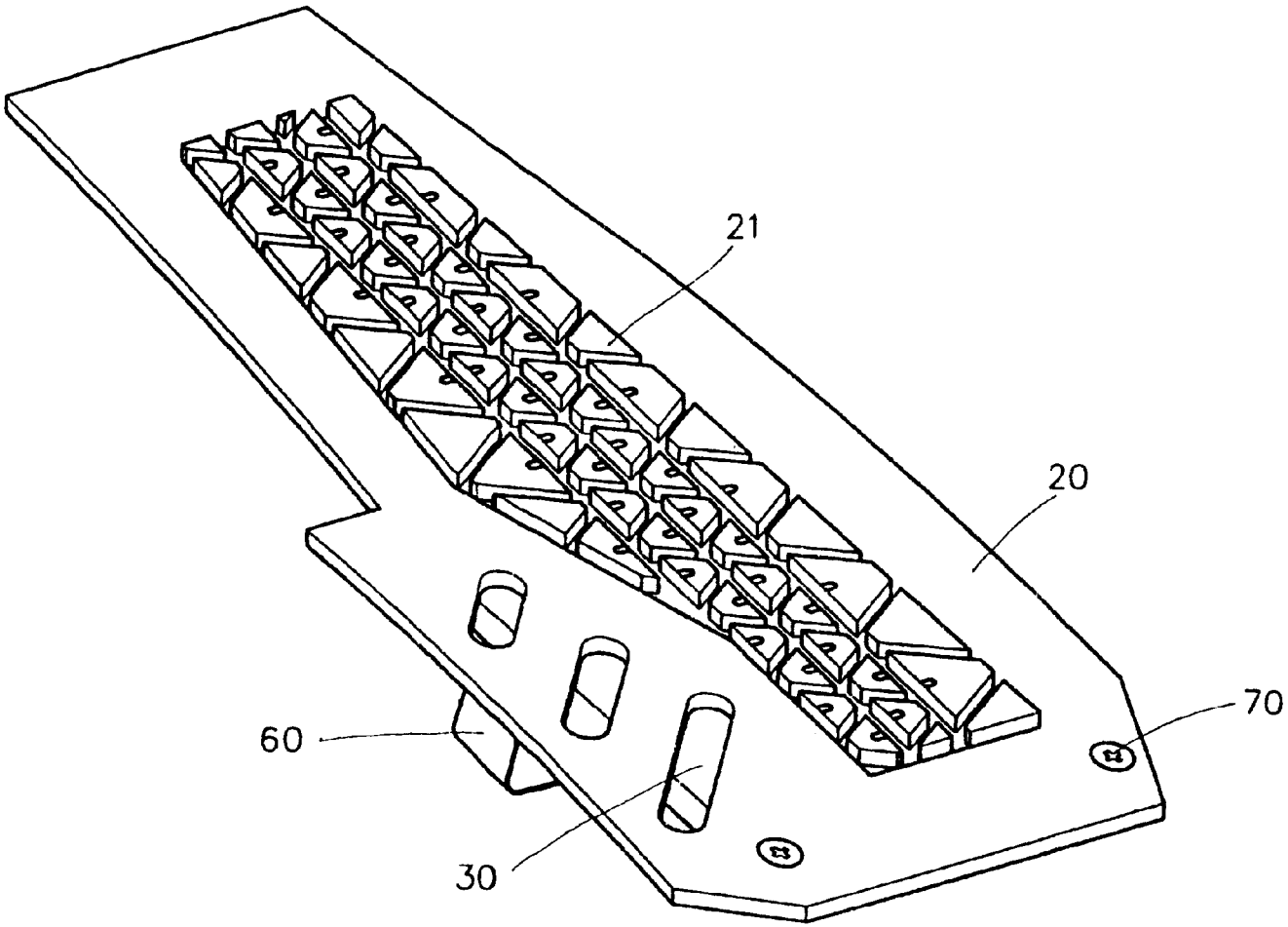
FIG. 3 shows a perspective view of the present invention in combination.
Figure 4:
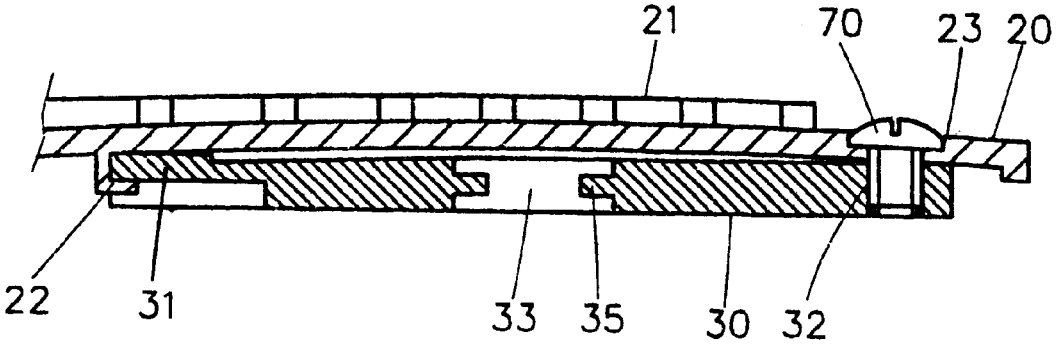
FIG.4 shots a sectional view of the present invention.
Figure 5:
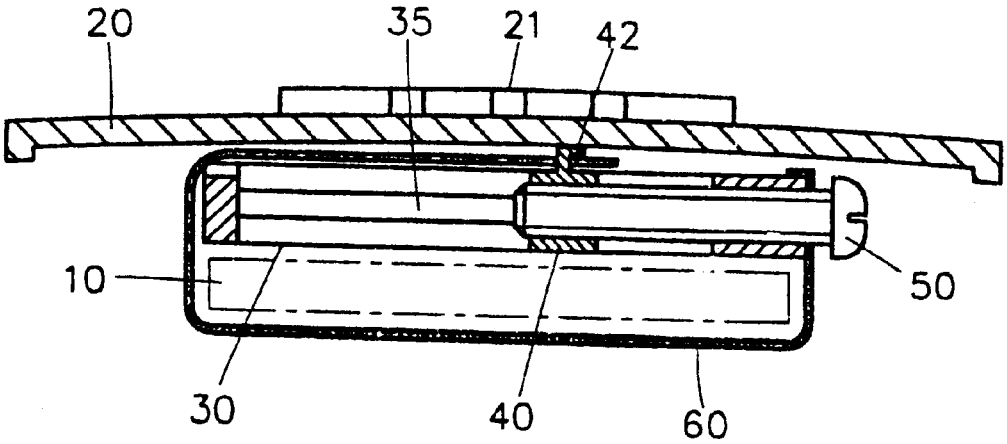
FIG. 5 shows another sectional vies of the present invention.

As shown in FIGS. 2–5, a skidproof cover embodied in the present invention is intended for use in covering the accelerator pedal, the brake pedal, or the clutch pedal of a motor vehicle. The skidproof cover is composed of a main body 20, a fastening piece 30, an actuating piece 40, a bolt 50, and a locating piece 60.

The main body 20 is provided on the upper surface thereof with a skidproof pad 21, and in the underside thereof with a retaining hook 22. The main body 20 is further provided in the periphery thereof with a plurality of through holes 23.

The fastening piece 30 is provided in one side thereof with a retaining portion 31 and is further provided with a plurality of through holes 32 corresponding in location to the through holes 23 of the main body 20. The fastening piece 30 is still further provided at the center of the upper surface thereof with a slot 33, and in one side thereof with a pivoting hole 34 opposite to the longitudinal end of the slot 33. Each of the two longitudinal sides of the slot 33 is provided with a rail 35.

The actuating piece 40 is provided respectively in two opposite ends thereof with an insertion slot 41 and is further provided in the upper surface thereof with a retaining portion 42, and in one side thereof with a threaded through hole 43.

The locating piece 60 is provided in one end thereof with a locating hole 61, and in another end thereof with a plurality of retaining slots 62 which are equidistantly separated from one another.

In combination, the locating piece 60 is fastened with a pedal 10 of the accelerator, brake or clutch of a car such that one end of the locating piece 60 holds securely the pedal 10, and that the fastening piece 30 is counted securely on the locating piece 60 by means of the bolt 50 which is engaged with the locating hole 61 of the locating piece 60 and the pivoting hole 34 of the fastening piece 30, and further that the retaining slot 62 is engaged with the retaining portion 42 of the actuating piece 40 which is slidably mounted on the two rails 35 of the slot 33 of the fastening piece 30. It must be noted here that the bolt 50 is also engaged with the threaded through hole 43 of the actuating piece 40. The main body 20 is mounted on the fastening piece 30 such that the retaining hook 22 of the main body 20 is engaged with the retaining portion 31 of the fastening piece. The main body 20 and the fastening piece 30 are joined together securely by a plurality of fastening screws 70 which are engaged with the through holes 23 of the main body 20 and the through holes 32 of the fastening piece 30. The actuating piece 40 can be forced by the bolt 50 to displace on the rails 35 so as to fasten the fastening piece 30 with the pedal 10 in conjunction with the locating piece 60.

What is claimed is:

1. A skidproof cover for covering a pedal of the accelerator, brake or clutch of a motor vehicle, said skidproof cover comprising:

a main body provided on an upper surface thereof with a skidproof pad attached thereto, in an underside thereof with a retaining hook, and in a periphery thereof with a plurality of through holes;

a fastening piece provided with a plurality of through holes for fastening thereon with said main body by a plurality of fastening screws which are engaged with said through holes of said fastening piece and said main body, said fastening piece further provided with a retaining portion, a slot, and a pivoting hole opposite to one end of said slot, said slot provided with two rails mounted along two opposite sides of said slot;

an actuating piece provided with a retaining portion and a threaded through hole which is engaged with a bolt capable of actuating said actuating piece to displace on said rails of said slot of said fastening piece so as to fasten said fastening piece with the pedal; and a locating piece provided with a locating hole and a plurality of retaining slots engageable with said retaining portion of said actuating piece, said locating piece being engaged with the pedal such that one end of said locating piece holds securely the pedal, and that the fastening piece is mounted on the locating piece by said bolt which is engaged with said locating hole of said locating piece, said pivoting hole of said fastening piece and said threaded through hole of said actuating piece.

* * * * *